US010160519B2

(12) United States Patent
Vandenworm

(10) Patent No.: US 10,160,519 B2
(45) **Date of Patent: *Dec. 25, 2018**

(54) BUOYANT STRUCTURE WITH FRAME AND KEEL SECTION

(71) Applicant: Nicolaas Johannes Vandenworm, Houston, TX (US)

(72) Inventor: Nicolaas Johannes Vandenworm, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/915,312

(22) Filed: Mar. 8, 2018

(65) Prior Publication Data

US 2018/0194436 A1 Jul. 12, 2018

Related U.S. Application Data

(63) Continuation of application No. 15/849,908, filed on Dec. 21, 2017, which is a continuation of application No. 15/821,180, filed on Nov. 22, 2017, which is a continuation of application No. 15/821,158, filed on Nov. 22, 2017, now Pat. No. 9,969,466, which is a continuation-in-part of application No. 15/798,078, filed on Oct. 30, 2017, which is a continuation of application No. 15/705,073, filed on Sep. 14, 2017, which is a continuation of application No. 15/522,076, filed as application No. PCT/US2015/057397 on Oct. 26, 2015, which is a (Continued)

(51) Int. Cl.

| | |
|---|---|
| ***B63B 21/50*** | (2006.01) |
| *B63B 21/00* | (2006.01) |
| *B63B 35/44* | (2006.01) |
| *B63B 39/02* | (2006.01) |
| *B63B 1/04* | (2006.01) |

(52) U.S. Cl.

CPC ..... *B63B 21/50* (2013.01); *B63B 1/041* (2013.01); *B63B 39/02* (2013.01); *B63B 2021/003* (2013.01); *B63B 2035/4473* (2013.01)

(58) Field of Classification Search

CPC ..... B63B 21/50; B63B 35/44

See application file for complete search history.

(56) References Cited

U.S. PATENT DOCUMENTS

| | | | |
|---|---|---|---|
| 2,156,635 | A | 5/1939 | Mascuch et al. |
| 3,041,639 | A | 7/1962 | Atlas |

(Continued)

FOREIGN PATENT DOCUMENTS

| | | | |
|---|---|---|---|
| WO | WO2009136799 | A1 | 11/2002 |
| WO | WO2012005587 | A1 | 1/2012 |

*Primary Examiner* — Stephen P Avila

(74) *Attorney, Agent, or Firm* — Buskop Law Group, P.C.; Wendy Buskop

(57) ABSTRACT

A buoyant structure has a hull having a main deck. The hull further contains a lower inwardly-tapering frustoconical side section that extends from the main deck, a lower generally rounded section extending from the lower inwardly-tapering frustoconical side section, a generally rounded keel, and a fin-shaped appendage secured to a lower and an outer portion of the exterior of the hull proximate the generally rounded keel, the fin shaped appendage having a shape selected from the group consisting of: a triangular shape, a hump shape and a pair of connected triangular projections shape.

9 Claims, 18 Drawing Sheets

Related U.S. Application Data continuation of application No. 14/524,992, filed on Oct. 27, 2014, which is a continuation-in-part of application No. 14/105,321, filed on Dec. 13, 2013, now Pat. No. 8,869,727, which is a continuation-in-part of application No. 13/369,600, filed on Feb. 9, 2012, now Pat. No. 8,662,000, which is a continuation-in-part of application No. 12/914,709, filed on Oct. 28, 2010, now Pat. No. 8,251,003.

(60) Provisional application No. 61/521,701, filed on Aug. 9, 2011, provisional application No. 61/259,201, filed on Nov. 8, 2009.

(56) References Cited

U.S. PATENT DOCUMENTS 3,897,743 A * 8/1975 Schoonnnan ..... B63G 8/001 114/321
4,282,822 A 8/1981 Jackson
4,446,808 A 5/1984 Colin
4,502,551 A 3/1985 Rule
4,549,835 A 10/1985 Ando et al.
4,606,673 A 8/1986 Daniell
4,640,214 A 2/1987 Bruns
4,679,517 A 7/1987 Kramer
4,984,935 A 1/1991 de Oliveira Filho et al.
5,573,353 A 11/1996 Recalde
6,945,736 B2 12/2005 Smedel
7,958,835 B2 * 6/2011 Srinivasan ..... B63B 35/44 114/125
8,251,003 B2 8/2012 Vandenworm
8,662,000 B2 3/2014 Vandenworm
9,079,644 B2 7/2015 Aarsnes
9,340,264 B2 5/2016 Syvertsen
2009/0126616 A1 5/2009 Srinivasan
2013/0133563 A1 5/2013 Kroecker
2015/0175245 A1 6/2015 Huang
2015/0175246 A1 6/2015 Huang
2015/0344114 A1 12/2015 Huang

* cited by examiner

BUOYANT STRUCTURE WITH FRAME AND KEEL SECTION

CROSS REFERENCE TO RELATED APPLICATIONS

The present application is a Continuation and claims priority to and benefit of co-pending U.S. patent application Ser. No. 15/849,908 filed on Dec. 21, 2017, entitled "BUOYANT STRUCTURE," which is a Continuation and claims priority to co-pending U.S. patent application Ser. No. 15/821,180 filed on Nov. 22, 2017, entitled "METHOD FOR OFFSHORE FLOATING PETROLEUM PRODUCTION, STORAGE AND OFFLOADING WITH A BUOYANT STRUCTURE," and to co-pending U.S. patent application Ser. No. 15/821,158 filed Nov. 22, 2017, entitled "METHOD FOR OPERATING A DRILLER," which is a Continuation in Part and claims priority to co-pending U.S. patent application Ser. No. 15/798,078 filed on Oct. 30, 2017, entitled "FLOATING DRILLER," which is a Continuation of U.S. patent application Ser. No. 15/705,073 filed Sep. 14, 2017, entitled "BUOYANT STRUCTURE," which is a Continuation of U.S. patent application Ser. No. 15/522,076 filed on Apr. 26, 2017, entitled "BUOYANT STRUCTURE," which claims priority to and the benefit of co-pending National Phase Application PCT/US2015/057397 filed on Oct. 26, 2015, entitled "BUOYANT STRUCTURE," which claims priority of U.S. patent application Ser. No. 14/524,992 filed on Oct. 27, 2014, entitled "BUOYANT STRUCTURE," now abandoned, which is a Continuation in Part of issued U.S. patent application Ser. No. 14/105,321 filed on Dec. 13, 2013, entitled "BUOYANT STRUCTURE," issued as U.S. Pat. No. 8,869,727 on Oct. 28, 2014, which is a Continuation in Part of issued U.S. patent application Ser. No. 13/369,600 filed on Feb. 9, 2012, entitled "STABLE OFFSHORE FLOATING DEPOT," issued as U.S. Pat. No. 8,662,000 on Mar. 4, 2014, which is a Continuation in Part of issued U.S. patent application Ser. No. 12/914,709 filed on Oct. 28, 2010, entitled "OFFSHORE BUOYANT DRILLING, PRODUCTION, STORAGE AND OFFLOADING STRUCTURE," issued as U.S. Pat. No. 8,251,003 on Aug. 28, 2012, which claims the benefit of U.S. Provisional Patent Application Ser. No. 61/259,201 filed on Nov. 8, 2009, entitled "DRILLING, PRODUCTION, STORAGE AND OFFLOADING VESSEL," and U.S. Provisional Patent Application Ser. No. 61/262,533 filed on Nov. 18, 2009; entitled "DRILLING, PRODUCTION, STORAGE AND OFFLOADING VESSEL," and claims the benefit of U.S. Provisional Patent Application Ser. No. 61/521,701 filed on Aug. 9, 2011, entitled "FLOTEL OFFSHORE PLATFORM". These references are hereby incorporated in their entirety.

FIELD

The present embodiments generally relate to a buoyant structure for supporting offshore oil and gas operations.

BACKGROUND

A need exists for a buoyant structure that provides kinetic energy absorption capabilities.

A further need exists for a buoyant structure that provides wave damping and wave breakup.

The present embodiments meet these needs.

BRIEF DESCRIPTION OF THE DRAWINGS

The detailed description will be better understood in conjunction with the accompanying drawings as follows.

Figure 1:
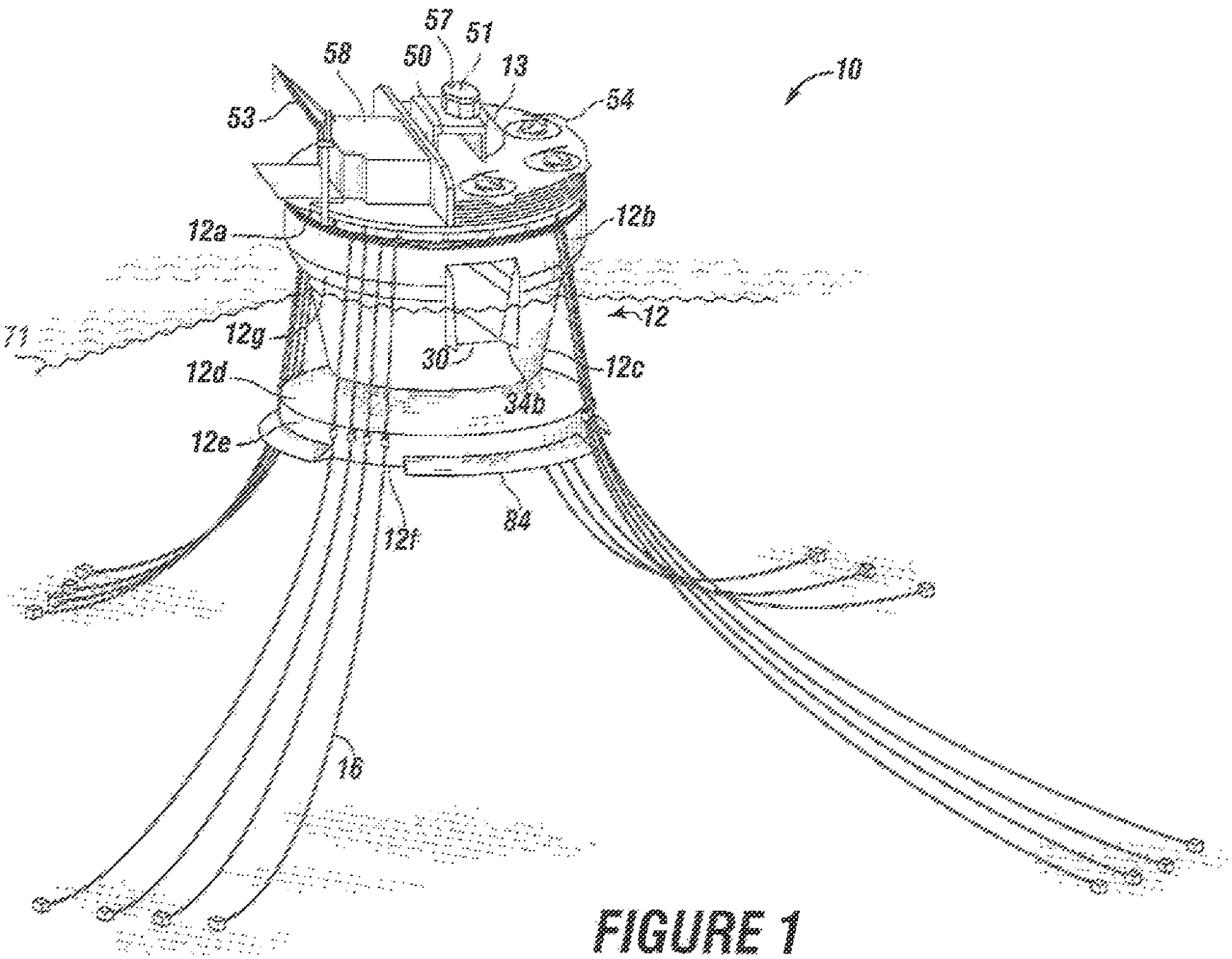
FIG. 1 is a perspective view of a buoyant structure.

The present embodiments are detailed below with reference to the listed Figures.

DETAILED DESCRIPTION OF THE EMBODIMENTS

Before explaining the present apparatus in detail, it is to be understood that the buoyant structure is not limited to the particular embodiments and that it can be practiced or carried out in various ways.

The present embodiments relate to a buoyant structure for supporting offshore oil and gas operations.

The embodiments relate to a buoyant structure with a hull having a main deck.

The hull has a lower inwardly-tapering frustoconical side section that extends from the main deck; a lower generally rounded section extending from the lower inwardly-tapering frustoconical side section; a generally rounded keel.

A fin-shaped appendage is secured to a lower and an outer portion of the exterior of the hull proximate the generally rounded keel. The fin shaped appendage has a shape selected from the group consisting of a triangular shape, a hump shape and a pair of connected triangular projections shape.

The hull can include an upper cylindrical side section extending from the main deck engaging the lower inwardly-tapering frustoconical side section.

The hull can include a cylindrical neck connected between the lower inwardly-tapering frustoconical side section and the lower generally rounded section.

The buoyant structure has a hull that can be ballasted to move between a transport depth and an operational depth. The fin shaped appendage can be configured to dampen movement of the buoyant structure as the buoyant structure moves in water.

In embodiments, the buoyant structure has on the main deck, a superstructure comprising at least one member selected from the group consisting of: crew accommodations, a heliport, a crane, a control tower, a dynamic position system in the control tower, and an aircraft hangar.

In embodiments, the hull can have a plurality of fin-shaped appendages separated from each other and disposed equidistantly around the hull.

The hull can include a lower frustoconical side section extending from the cylindrical neck.

In embodiments, the hull can include a lower frustoconical side section extending downwardly from the lower inwardly-tapering frustoconical side section.

In embodiments, a moveable center pendulum is configured to move between a transport depth and an operational depth.

In embodiments, a plurality of openings can be formed in in each lower generally rounded section for receiving inserts for ballasting.

The embodiments enable the offshore structure to be towed to an offshore disaster and operate as a command center to facilitate in the control of a disaster, and can act as a hospital, or triage center.

The following definition is used herein:

The term "cofferdam" refers to a watertight enclosure placed or constructed under water and configured to be pumped dry such as, for construction, or to allow repairs to proceed under normal conditions or for storage of a dry substance or a fluid. The dry substance can be material having a mass such as a particulate, or air.

The term "nearly fully enclosed tubular channel" can be defined as a tubular channel that is 80 percent to 90 percent enclosed.

Turning now to the Figures, FIG. 1 depicts a buoyant structure 10 for operationally supporting offshore exploration, drilling, production, and storage installations according to an embodiment of the invention.

The buoyant structure 10 can include a hull 12, which can carry a superstructure 13 thereon. The superstructure 13 can include a diverse collection of equipment and structures, such as living quarters and crew accommodations 58, equipment storage, a heliport 54, and a myriad of other structures, systems, and equipment, depending on the type of offshore operations to be supported. Cranes 53 can be mounted to the superstructure 13. The superstructure 13 can include an aircraft hangar 50. A control tower 51 can be built on the superstructure 13. The control tower 51 can have a dynamic position system 57.

The hull 12 can be moored to the seafloor by a number of catenary mooring lines 16.

The buoyant structure 10 can have a tunnel 30 with a tunnel opening 31 in the hull 12 to locations exterior of the tunnel 30.

The tunnel 30 can receive water while the buoyant structure 10 is at an operational depth 71.

The buoyant structure 10 can have a unique hull shape.

Figure 2:
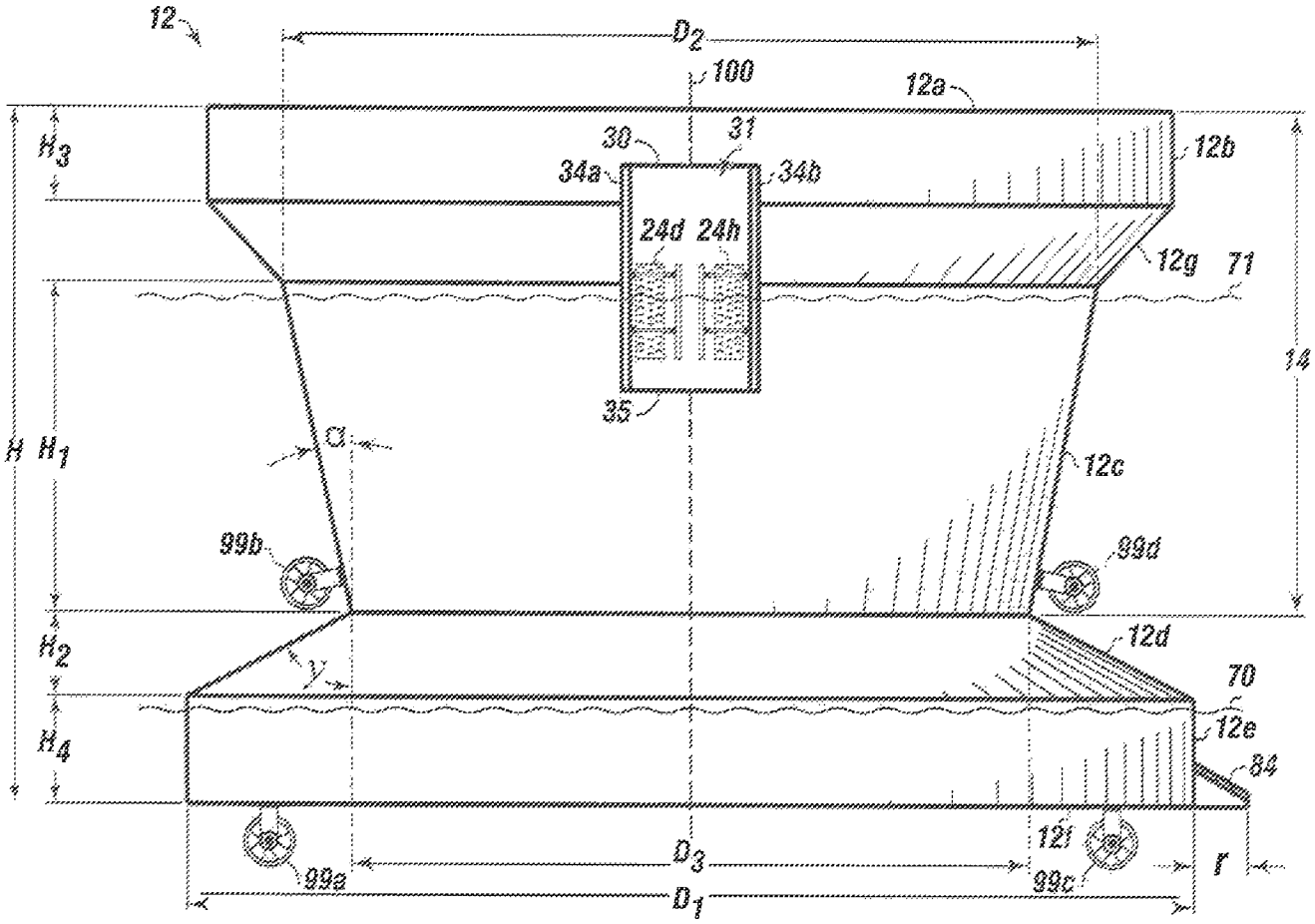
FIG. 2 is a vertical profile drawing of the hull of the buoyant structure.

Referring to FIGS. 1 and 2, the hull 12 of the buoyant structure 10 can have a main deck 12*a*, which can be circular; and a height H. Extending downwardly from the main deck 12*a* can be an upper frustoconical portion 14.

In embodiments, the upper frustoconical portion 14 can have an upper cylindrical side section 12*b* extending downwardly from the main deck 12*a*, an inwardly tapering upper frustoconical side section 12*g* located below the upper cylindrical side section 12*b* and connecting to a lower inwardly tapering frustoconical side section 12*c*.

The buoyant structure 10 also can have a lower frustoconical side section 12*d* extending downwardly from the lower inwardly tapering frustoconical side section 12*c* and flares outwardly. Both the lower inwardly tapering frustoconical side section 12*c* and the lower frustoconical side section 12*d* can be below the operational depth 71.

A lower generally rounded section 12*e* can extend downwardly from the lower frustoconical side section 12*d*, and have a matching generally rounded keel 12*f*.

The lower inwardly tapering frustoconical side section 12*c* can have a substantially greater vertical height H1 than lower frustoconical side section 12*d* shown as H2. Upper cylindrical side section 12*b* can have a slightly greater vertical height H3 than lower generally rounded section 12*e* shown as H4.

As shown, the upper cylindrical side section 12*b* can connect to inwardly tapering upper frustoconical side section 12*g* so as to provide for a main deck 12*a* of greater radius than the hull radius. The superstructure 13 can be round, square or another shape, such as a half moon. Inwardly tapering upper frustoconical side section 12*g* can be located above the operational depth 71.

The tunnel 30 can have at least one closable door 34*a* and 34*b* that alternatively, or in combination, can provide for weather and water protection to the tunnel 30.

Fin-shaped appendages 84 can be attached to a lower and an outer portion of the exterior of the hull 12.

The hull 12 is depicted with a plurality of catenary mooring lines 16 for mooring the buoyant structure 10 to create a mooring spread, 12 catenary mooring lines 16 are shown but from 3 to 24 can be used.

FIG. 2 is a simplified view of a vertical profile of the hull 12 according to an embodiment.

The tunnel 30 can have a plurality of dynamic movable tendering mechanisms 24*a*-24*h* disposed within and connected to the tunnel sides.

In an embodiment, the tunnel 30 can have closable doors 34*a* and 34*b* for opening and closing the tunnel opening 31.

Two different depths are shown, the operational depth 71 and the transit depth 70.

The operational depth 71 can be from about 45 meters to about 65 meters, and the transit depth 70 can be from about 7 meters to about 15 meters. The tunnel can be out of water during transit.

The tunnel floor 35 can accept water when the buoyant structure 10 is at an operational depth 71.

The dynamic movable tendering mechanisms 24*d*-24*h* can be oriented above the tunnel floor 35 and can have portions that are positioned both above the operational depth 71 and extend below the operational depth 71 inside the tunnel 30.

The operational depth 71 is achieved using ballast pumps and filling ballast tanks in the hull 12 with water after moving the structure at transit depth 70 to an operational location.

The main deck 12*a*, upper cylindrical side section 12*b*, inwardly-tapering upper frustoconical side section 12*g*, lower inwardly-tapering frustoconical side section 12*c*, lower frustoconical side section 12*d*, lower generally rounded section 12*e*, and matching generally rounded keel 12*f* are all co-axial with a common vertical axis 100. In embodiments, the hull 12 can be characterized by a generally rounded cross section when taken perpendicular to the vertical axis 100 at any elevation.

Due to the generally rounded planform, the dynamic response of the hull 12 is independent of wave direction (when neglecting any asymmetries in the mooring system, risers, and underwater appendages), thereby minimizing wave-induced yaw forces. Additionally, the conical form of the hull 12 is structurally efficient, offering a high payload and storage volume per ton of steel when compared to traditional ship-shaped offshore structures. The hull 12 can have generally rounded walls, which are generally rounded in radial cross-section, but such shape may be approximated using a large number of flat metal plates rather than bending plates into a desired curvature. Although a generally rounded hull planform is preferred, a polygonal hull planform can be used according to alternative embodiments.

In embodiments, the hull 12 can be circular, oval or elliptical forming the generally rounded planform.

An elliptical shape can be advantageous when the buoyant structure 10 is moored closely adjacent to another offshore platform so as to allow gangway passage between the two structures. An elliptical hull can minimize or eliminate wave interference.

The specific design of the lower inwardly-tapering frustoconical side section 12*c* and the lower frustoconical side section 12*d* generates a significant amount of radiation damping resulting in almost no heave amplification for any wave period, as described below.

Lower inwardly tapering frustoconical side section 12*c* can be located in the wave zone. At operational depth 71, the waterline can be located on lower inwardly tapering frustoconical side section 12*c* just below the intersection with upper cylindrical side section 12*b*. Lower inwardly tapering frustoconical side section 12*c* can slope at an angle with respect to the vertical axis 100, that varies from 10 degrees to 15 degrees. The inward flare before reaching the waterline significantly dampens downward heave, because a downward motion of the hull 12 increases the water plane area. In other words, the hull area normal to the vertical axis 100 that breaks the water's surface will increase with downward hull motion, and such increased area is subject to the opposing resistance of the air and or water interface. It has been found that from 10 degrees to 15 degrees of flare provides a desirable amount of damping of downward heave without sacrificing too much storage volume for the buoyant structure 10.

Similarly, lower frustoconical side section 12*d* dampens upward heave. The lower frustoconical side section 12*d* can be located below the wave zone (about 30 meters below the waterline). Because the entire lower frustoconical side section 12*d* can be below the water surface, a greater area (normal to the vertical axis 100) is desired to achieve upward damping. Accordingly, the first diameter D1 of the lower hull section can be greater than the second diameter D2 of the lower inwardly tapering frustoconical side section 12*c*. The lower frustoconical side section 12*d* can slope at an angle (with respect to the vertical axis 100, that ranges from 55 degrees to 65 degrees.) The lower section can flare outwardly at an angle greater than or equal to 55 degrees to provide greater inertia for heave roll and pitch motions. The increased mass contributes to natural periods for heave pitch and roll above the expected wave energy. The upper bound of 65 degrees is based on avoiding abrupt changes in stability during initial ballasting on installation. That is, lower frustoconical side section 12*d* can be perpendicular to the vertical axis 100 and achieve a desired amount of upward heave damping, but such a hull profile would result in an undesirable step-change in stability during initial ballasting on installation. The connection point between upper frustoconical portion 14 and the lower frustoconical side section 12*d* can have a third diameter D3 smaller than the first and second diameters D1 and D2.

The transit depth 70 represents the waterline of the hull 12 while it is being transited to an operational offshore position. The transit depth 70 is known in the art to reduce the amount of energy required to transit a buoyant vessel across distances on the water by decreasing the profile of buoyant structure 10 which contacts the water. The transit depth 70 is roughly the intersection of lower frustoconical side section 12*d* and lower generally rounded section 12*e*. However, weather and wind conditions can provide need for a different transit depth 70 to meet safety guidelines or to achieve a rapid deployment from one position on the water to another.

The term "buoyant structure" refers to a floating vessel with a low center of gravity providing an inherent positive stability.

The term "low center of gravity" refers to a center of gravity that is positive when compared to metacentric height of a buoyant vessel.

The hull 12 is characterized by a relatively high metacenter. But, because the center of gravity (CG) is low, the metacentric height is further enhanced, resulting in large righting moments. Additionally, the peripheral location of the fixed ballast further increases the righting moments.

The buoyant structure 10 aggressively resists roll and pitch and is said to be "stiff." Stiff vessels are typically characterized by abrupt jerky accelerations as the large righting moments counter pitch and roll. However, the inertia associated with the high total mass of the buoyant structure 10, enhanced specifically by the fixed ballast, mitigates such accelerations. In particular, the mass of the fixed ballast increases the natural period of the buoyant structure 10 to above the period of the most common waves, thereby limiting wave-induced acceleration in all degrees of freedom.

In an embodiment, the buoyant structure 10 can have thrusters 99*a*-99*d*.

Figure 3:
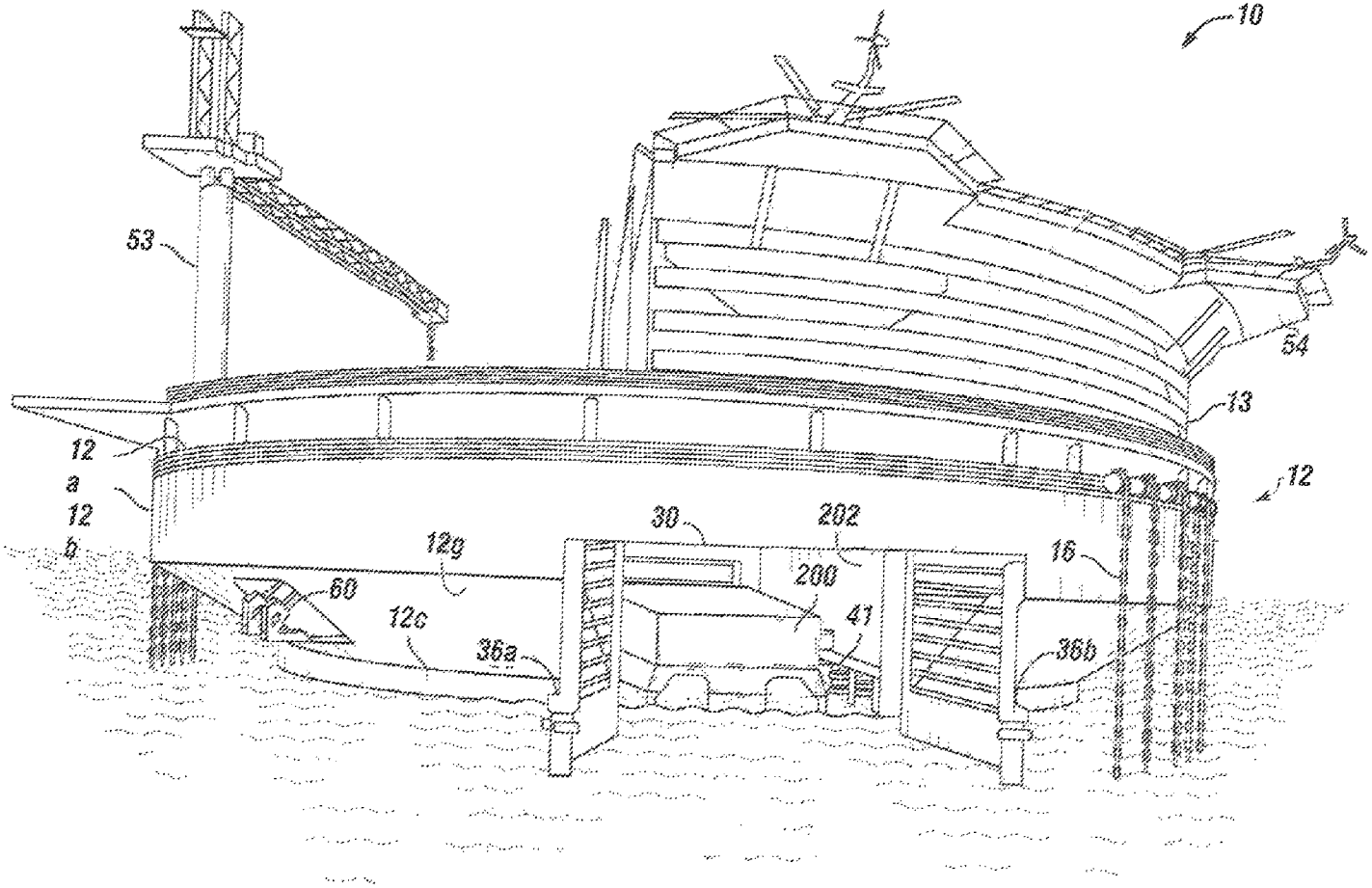
FIG. 3 is an enlarged perspective view of the floating buoyant structure at operational depth.

FIG. 3 shows the buoyant structure 10 with the main deck 12*a* and the superstructure 13 over the main deck 12*a*.

In embodiments, the crane 53 can be mounted to the superstructure 13, which can include a heliport 54.

In this view, a watercraft 200 is in the tunnel 30, having come into the tunnel through the tunnel opening 31 and is positioned between the tunnel sides, of which tunnel side 202 is labeled. A boatlift 41 is also shown in the tunnel 30, which can raise the watercraft above the operational depth 71 in the tunnel 30.

The tunnel opening 31 is shown with two doors, each door having a door fender 36*a* and 36*b* for mitigating damage to a watercraft attempting to enter the tunnel 30, but not hitting the doors.

The door fenders 36*a-b* can allow the watercraft to impact the door fenders 36*a-b* safely if the pilot cannot enter the tunnel 30 directly due to at least one of large wave and high current movement from a location exterior of the hull 12.

The catenary mooring lines 16 are shown coming from the upper cylindrical side section 12*b*.

A berthing facility 60 is shown in the hull 12 in the portion of the inwardly tapering upper frustoconical side section 12*g*. The inwardly tapering upper frustoconical side section 12*g* is shown connected to the lower inwardly tapering frustoconical side section 12*c* and the upper cylindrical side section 12*b*.

Figure 4A:
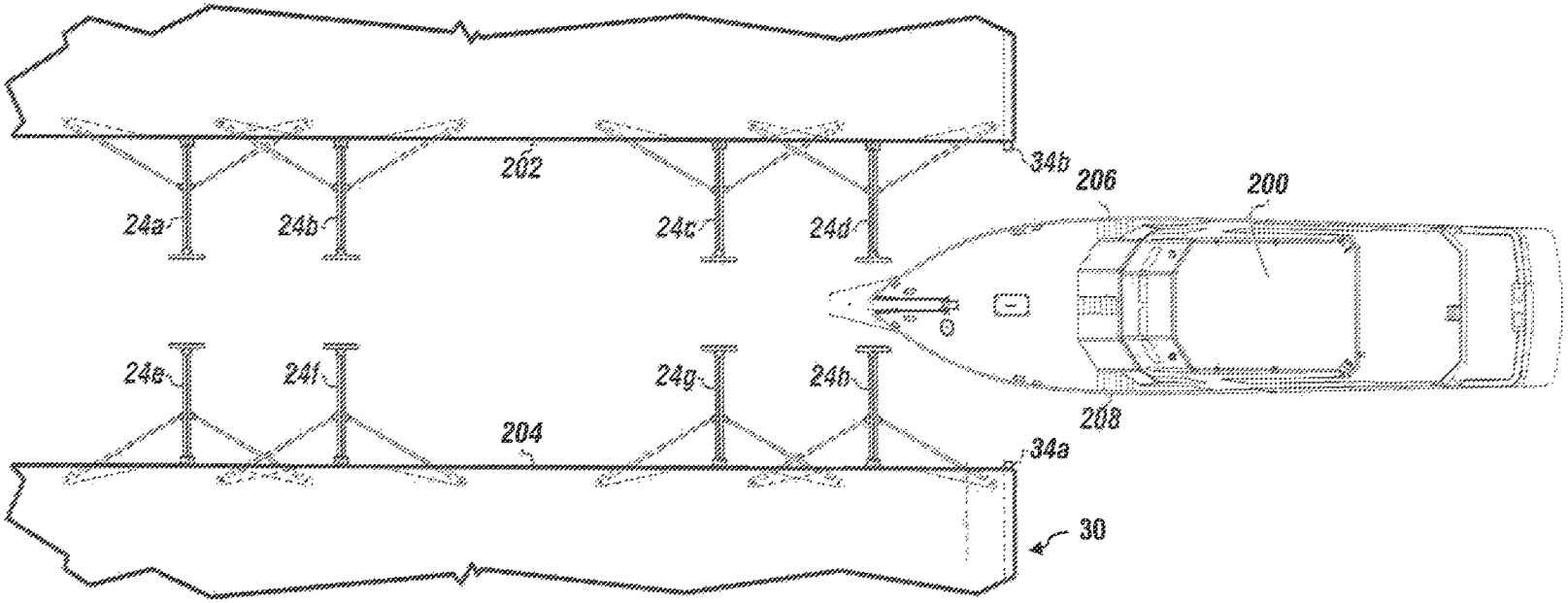
FIG. 4A is a top view of a plurality of dynamic moveable tendering mechanisms in a tunnel before a watercraft has contacted the dynamic moveable tendering mechanisms.

FIG. 4A shows the watercraft 200 entering the tunnel 30 between tunnel sides 202 and 204 and connecting to the plurality of dynamic movable tendering mechanisms 24*a*-24*h*. Proximate to the tunnel opening 31 are closable doors 34*a* and 34*b* which can be sliding pocket doors to provide either a weather tight or watertight protection of the tunnel 30 from the exterior environment. The starboard side 206 hull and port side 208 hull of the watercraft 200 are also shown.

Figure 4B:
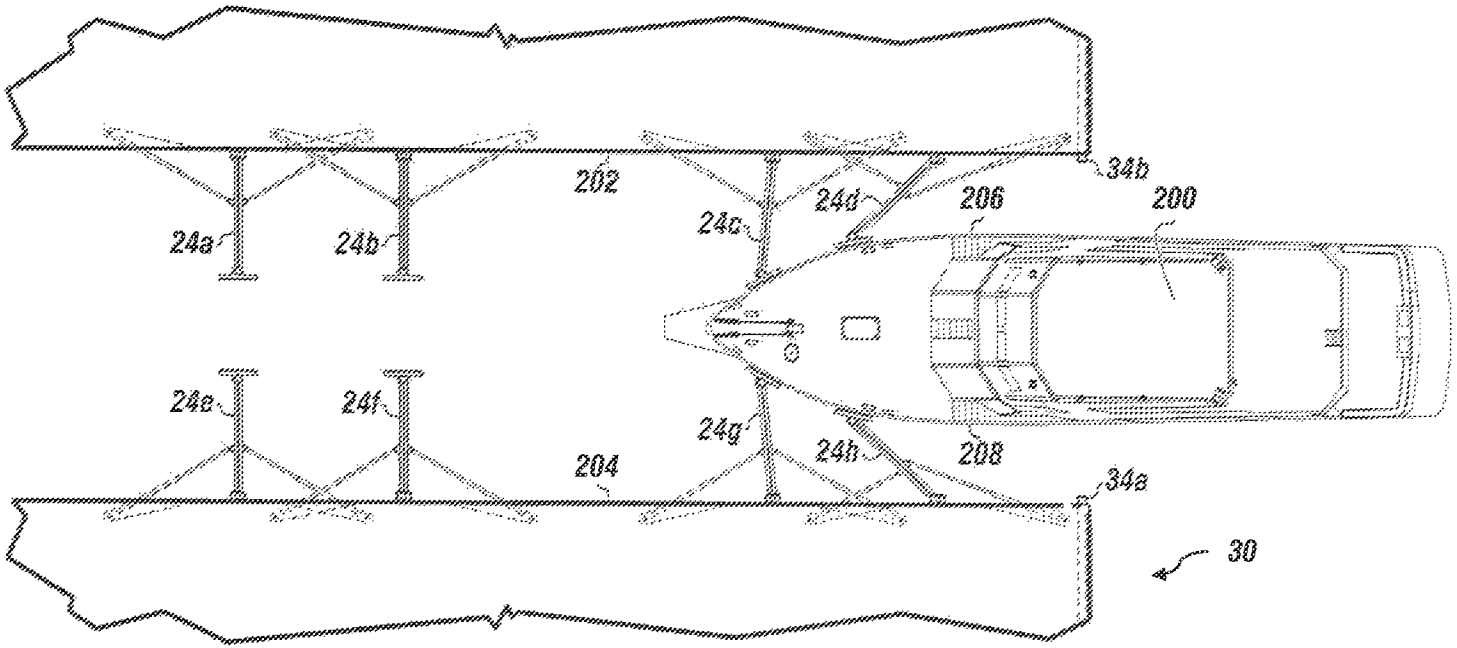
FIG. 4B is a top view of a plurality of dynamic moveable tendering mechanisms in a tunnel as the hull of a watercraft has contacted the dynamic moveable tendering mechanisms.

FIG. 4B shows the watercraft 200 inside a portion of the tunnel 30 between tunnel sides 202 and 204 and connecting to the plurality of dynamic movable tendering mechanisms 24*a*-24*h*. Dynamic moveable tendering mechanisms 24*g* and 24*h* are shown contacting the port side 208 hull of the watercraft 200. Dynamic moveable tendering mechanisms 24*c* and 24*d* are seen contacting the starboard side 206 hull of the watercraft 200. The closable doors 34*a* and 34*b* are also shown.

Figure 4C:
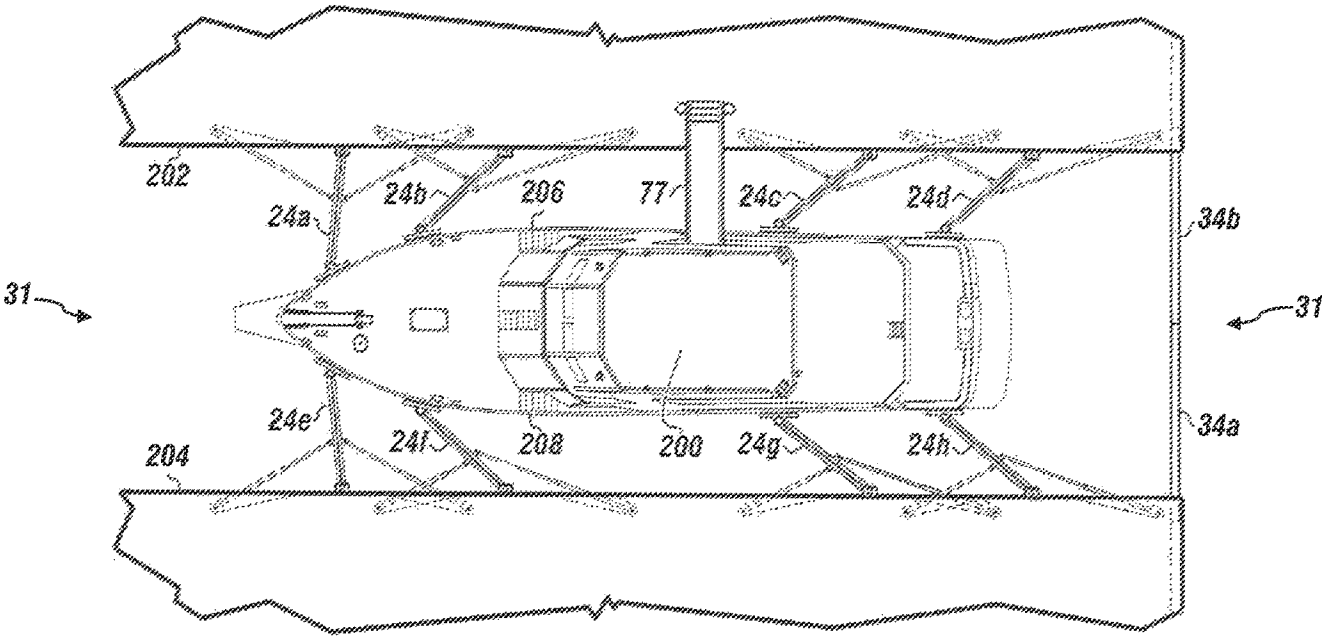
FIG. 4C is a top view of a plurality of dynamic moveable tendering mechanisms in a tunnel connecting to the watercraft with the doors closed.

FIG. 4C shows the watercraft 200 in the tunnel 30 between tunnel sides 202 and 204 and connecting to the plurality of dynamic movable tendering mechanisms 24*a*-24*h* and also connected to a gangway 77. Proximate to the tunnel opening 31 are closable doors 34*a* and 34*b* which can be sliding pocket doors oriented in a closed position providing either a weather tight or watertight protection of the tunnel from the exterior environment. The plurality of the dynamic moveable tendering mechanisms 24*a*-24*h* are shown in contact with the hull of the watercraft 200 on both the starboard side 206 and port side 208.

Figure 5:
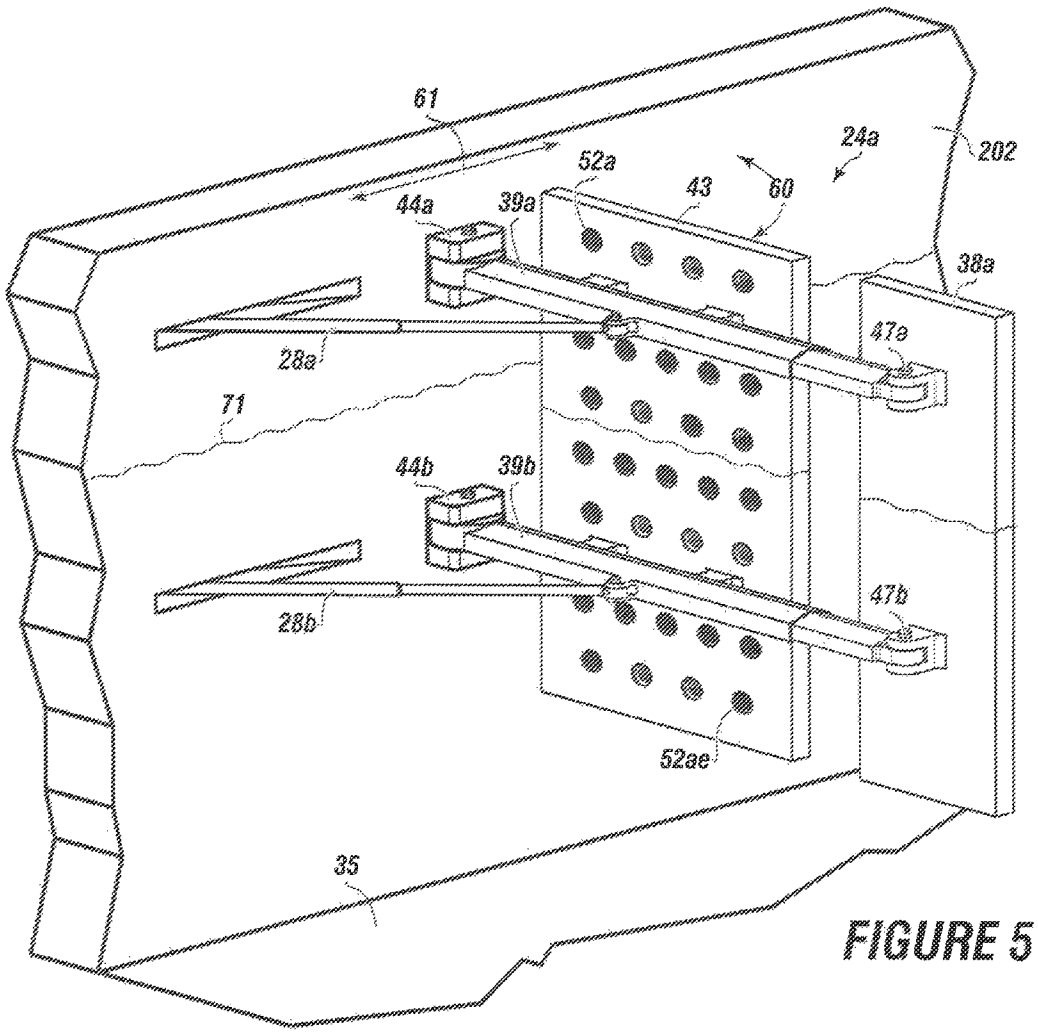
FIG. 5 is an elevated perspective view of one of the dynamic moveable tendering mechanisms.

FIG. 5 shows one of the plurality of the dynamic movable tendering mechanisms 24*a*-24*h*. Each dynamic movable tendering mechanism can have a pair of parallel arms 39*a* and 39*b* mounted to a tunnel side, shown as tunnel side 202 in this Figure.

A fender 38*a* can connect to the pair of parallel arm 39*a* and 39*b* on the sides of the parallel arms opposite the tunnel side.

A plate 43 can be mounted to the pair of parallel arms 39*a* and 39*b* and between the fender 38*a* and the tunnel side 202.

The plate 43 can be mounted above the tunnel floor 35 and positioned to extend above the operational depth 71 in the tunnel and below the operational depth 71 in the tunnel simultaneously.

The plate 43 can be configured to dampen movement of the watercraft 200 as the watercraft 200 moves from side to side in the tunnel 30. The plate and entire dynamic movable tendering mechanism can prevent damage to the ship hull, and push a watercraft 200 away from a ship hull without breaking towards the tunnel center. The embodiments can allow a buoyant structure 10 to bounce in the tunnel 30 without damage.

In embodiments, the plates 43, closable doors, and hull 12 can be made from steel.

A plurality of pivot anchors 44*a* and 44*b* can connect one of the parallel arms to the tunnel side.

Each pivot anchor can enable the plate to swing from a collapsed orientation against the tunnel sides to an extended orientation at an angle 60, which can be up to 90 degrees from a plane 61 of the wall enabling the plate on the parallel arm and the fender to simultaneously (i) shield the tunnel 30 from waves and water sloshing effects, (ii) absorb kinetic energy of the watercraft 200 as the watercraft 200 moves in the tunnel 30, and (iii) apply a three to push against the watercraft 200 keeping the watercraft 200 away from the side of the tunnel 30.

A plurality of fender pivots 47*a* and 47*b* are shown, wherein each pivot can form a connection between each parallel arm and the fender 38*a*, each fender pivot can allow the fender to pivot from one side of the parallel arm to an opposite side of the parallel arm through at least 90 degrees as the watercraft 200 contacts the fender 38*a*.

A plurality of openings 52*a*-52*ae* in the plate 43 can reduce wave action. Each opening can have a diameter from 0.1 meters to 2 meters. In embodiments, the openings 52 can be ellipses.

At least one hydraulic cylinder 28*a* and 28*b* can be connected to each parallel arm for providing resistance to watercraft 200 pressure on the fender 38*a* and for extending and retracting the plate from the tunnel sides.

Figure 6:
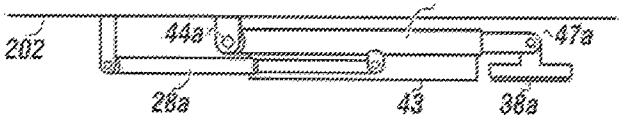
FIG. 6 is a collapsed top view of one of the dynamic moveable tendering mechanisms.

FIG. 6 shows one of the pair of parallel arms 39*a* mounted to a tunnel side 202 in a collapsed position.

The parallel arm 39*a* can be connected to the pivot anchor 44*a* that engages the tunnel side 202.

Fender pivot 47*a* can be mounted on the parallel arm opposite the pivot anchor.

The fender 38*a* can be mounted to the fender pivot 47*a*.

The plate 43 can be attached to the parallel arm 39*a*.

The hydraulic cylinder 28*a* can be attached to the parallel arm and the tunnel wall.

Figure 7:
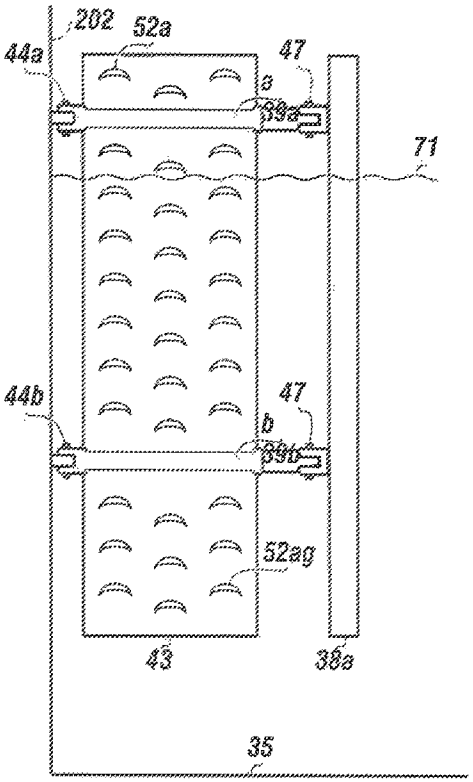
FIG. 7 is a side view of an embodiment of the dynamic moveable tendering mechanism.

FIG. 7 shows the plate 43 with openings 52*a*-52*ag* that can be generally rounded in shape, wherein the plate is shown mounted above the tunnel floor 35.

The plate can extend both above and below the operational depth 71.

The tunnel side 202, pivot anchors 44*a* and 44*b*, parallel arms 39*a* and 39*b*, fender pivots 47*a* and 47*b*, and the fender 38*a* are also shown.

Figure 8:
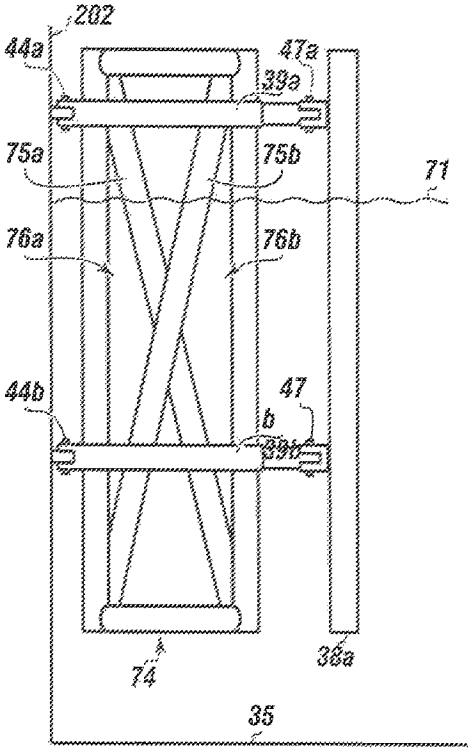
FIG. 8 is a side view of another embodiment of the dynamic moveable tendering mechanism.

FIG. 8 shows an embodiment of a dynamic moveable tendering mechanism formed from a frame 74 instead of the plate. The frame 74 can have intersecting tubulars 75*a* and 75*b* that form openings 76*a* and 76*b* for allowing water to pass while water in the tunnel 30 is at an operational depth 71.

The tunnel side 202, tunnel floor 35, pivot anchors 44*a* and 44*b*, parallel arms 39*a* and 39*b*, fender pivots 47*a* and 47*b*, and fender 38*a* are also shown.

Figure 9:
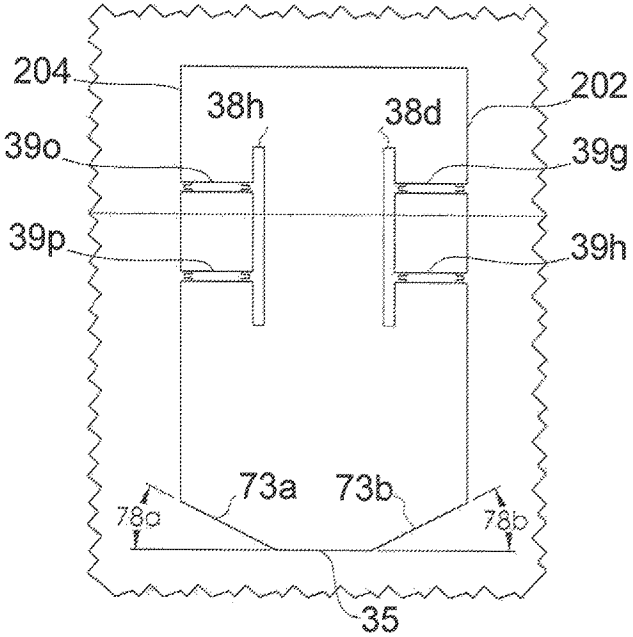
FIG. 9 is a cut away view of the tunnel.

FIG. 9 shows the tunnel floor 35 having lower tapering surfaces 73*a* and 73*b* at an entrance of the tunnel, providing a "beach effect" that absorbs surface wave energy effect inside of the tunnel. The lower tapering surfaces can be at an angle 78*a* and 78*b* that is from 3 degrees to 40 degrees.

Two fenders 38*h* and 38*d* can be mounted between two pairs of parallel arms. The fender 38*h* can be mounted between parallel arms 39*o* and 39*p*, and the fender 38*d* can be mounted between parallel arms 39*g* and 39*h*.

In embodiments, the pair of parallel arms can be simultaneously extendable and retractable.

The tunnel walls 202 and 204 are also shown.

Figure 10A:
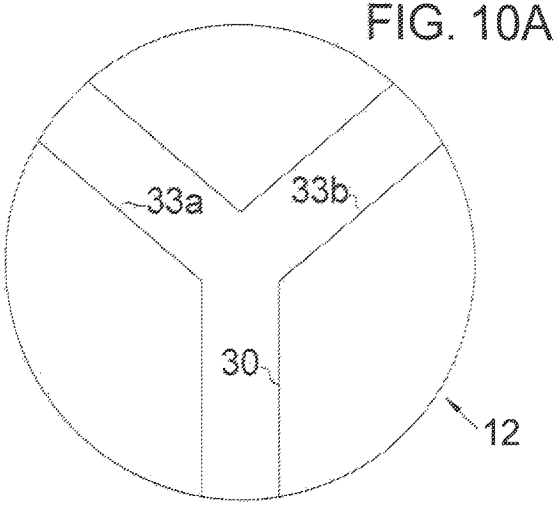
FIGS. 10A and 10B is a top view of a Y-shaped tunnel in the hull of the buoyant structure.

FIG. 10A shows a Y-shaped configuration from a top cutaway view of the hull 12 with the tunnel 30 with the tunnel opening, in communication with a branch 33*a* and branch 33*b* going to additional openings 32*a* and 32*b* respectively.

Figure 10B:
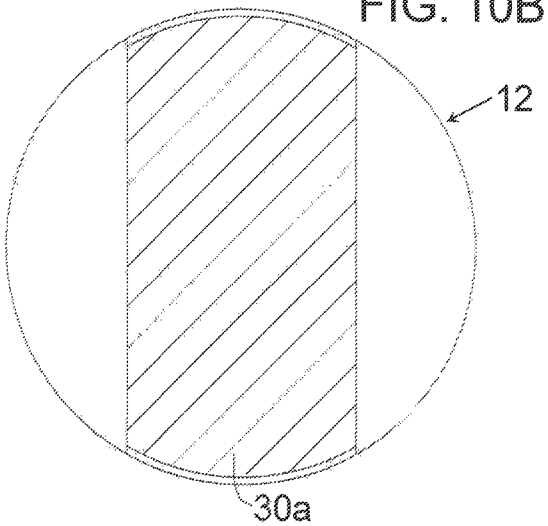

FIG. 10B shows a one-way tunnel 30 without the Y-shaped configuration. The tunnel has openings, which go through the hull 12.

Straight, curved, or tapering sections in the hull can form the tunnel 30.

Figure 11:
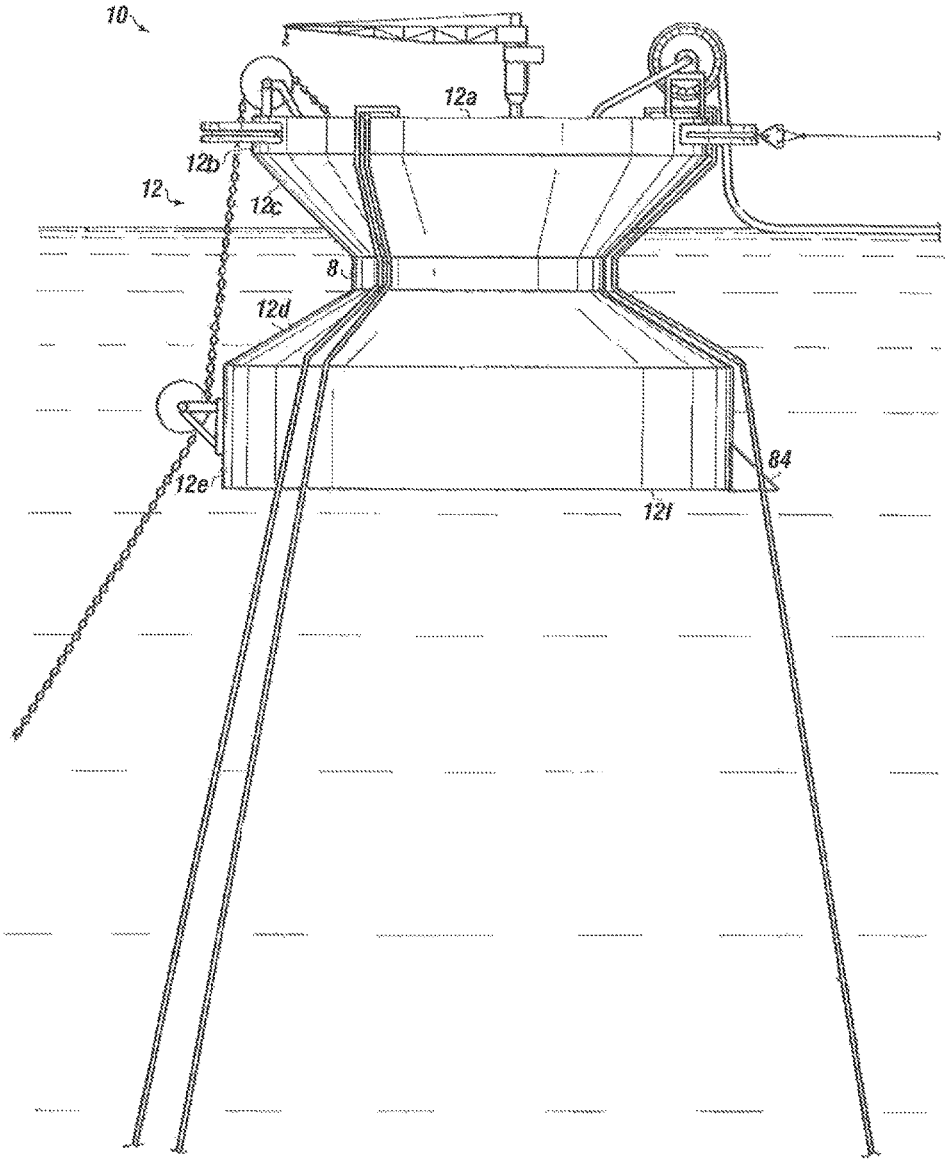
FIG. 11 is a side view of the buoyant structure with a cylindrical neck.

FIG. 11 is a side view of the buoyant structure 10 with a cylindrical neck.

The buoyant structure 10 is shown having a hull 12 with a main deck 12*a*.

The buoyant structure 10 has an upper cylindrical side section 12*b* extending downwardly from the main deck 12*a* and a lower inwardly tapering frustoconical side section 12*c* extending from the upper cylindrical side section 12*b*.

The buoyant structure 10 has a cylindrical neck 8 connecting to the lower inwardly tapering frustoconical side section 12*c*.

A lower frustoconical side section 12*d* extends from the cylindrical neck 8.

A lower generally rounded section 12*e* connects to the lower frustoconical side section 12*d*.

A generally rounded keel 12*f* is formed at the bottom of the lower generally rounded section 12*e*.

A fin-shaped appendage 84 is secured to a lower and an outer portion of the exterior of the generally rounded keel 12*f*.

Figure 12:
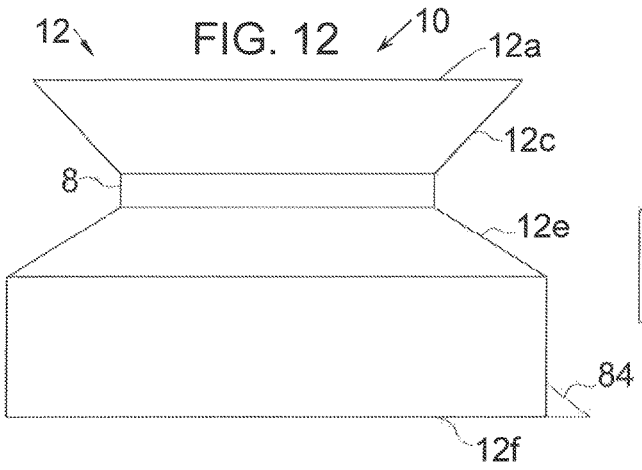
FIG. 12 is detailed view of another embodiment of the buoyant structure with a cylindrical neck in a transport configuration.

FIG. 12 is detailed view of the buoyant structure 10 having a hull 12 with a cylindrical neck 8.

A lower inwardly tapering frustoconical side section 12*c* extends from a main deck 12*a* to the cylindrical neck 8.

A lower generally rounded section 12*e* extends from the cylindrical neck opposite the lower inwardly tapering frustoconical side section 12*c*.

A generally rounded keel 12*f* is at the bottom of the lower generally rounded section 12*e*.

A fin-shaped appendage 84 is shown secured to a lower and an outer portion of the exterior of the generally rounded keel 12*f* and extends from the generally rounded keel 12*f* into the water.

Figure 13A:
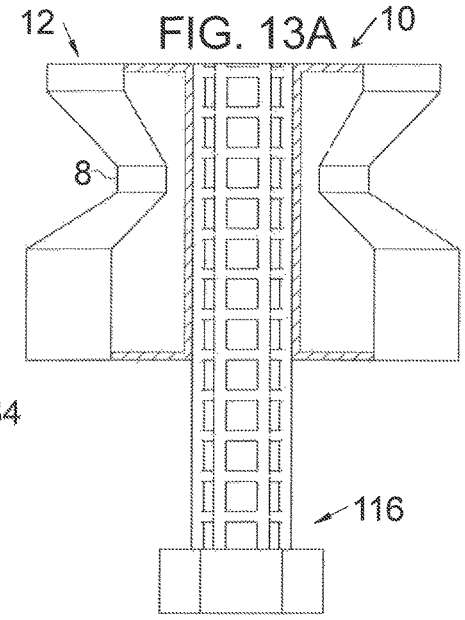
FIG. 13A is a cut away view of another embodiment of the buoyant structure with a cylindrical neck in a transport configuration with a central pendulum.

FIG. 13A is a cut away view of the buoyant structure 10 having a hull 12 with a cylindrical neck 8 and a raised center pendulum 116 in a transport configuration.

In embodiments, the buoyant structure 10 can have a pendulum 116, which can be moveable. In embodiments, the pendulum is optional and can be partly incorporated into the hull 12 to provide optional adjustments to the overall hull performance.

In this FIG. 13A, the pendulum 116 is shown at a transport depth.

In embodiments, the moveable pendulum can be configured to move between a transport depth and an operational depth 71 and the pendulum can be configured to dampen movement of the watercraft 200 as the watercraft 200 moves from side to side in the water.

Figure 13B:
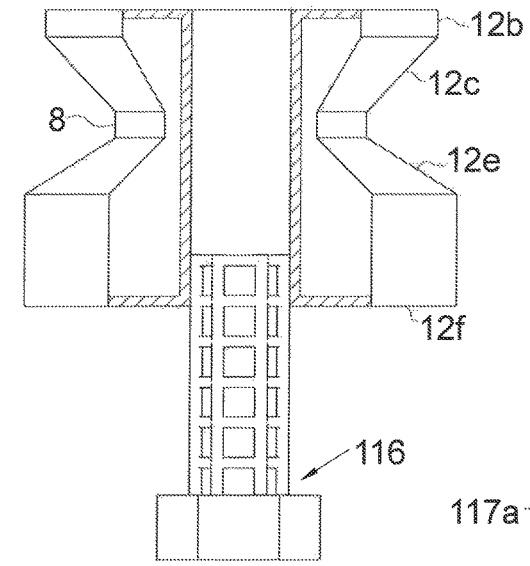
FIG. 13B is a cut away view of the buoyant structure with a cylindrical neck in an operational configuration.

FIG. 13B is a cut away view of the buoyant structure 10 with a cylindrical neck 8 in an operational configuration.

Figure 14:
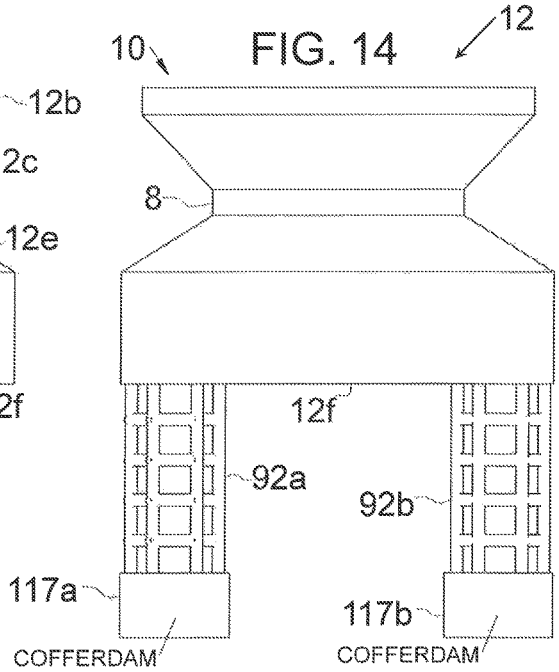
FIG. 14 is a side view of the buoyant structure with a cylindrical neck and two sets of parallel frames extending front the keel each set of parallel frames having a keel extension. The sets of parallel frames mounted in parallel with each other and connected to the generally rounded keel.

FIG. 14 shows the buoyant structure 10 with a set of parallel frames 92*a*-92*d* extending from the hull 12. Attached to the set of parallel frames is a keel extension 117*a*.

The keel extension 117*a* can be a pair of cofferdams mounted in parallel separated by the parallel frames or a pair of cofferdams mounted with the parallel frames mounted apart and in parallel to each other. The keel extension can be a cofferdam containing a portion of a group of the parallel frames.

The buoyant structure 10 is shown with a lower inwardly tapering frustoconical side section 12*c* extending to the cylindrical neck 8.

A lower generally rounded section 12*e* extends from the cylindrical neck 8 opposite the lower inwardly tapering frustoconical side section 12*c*.

A generally rounded keel 12*f* is at the bottom of the lower generally rounded section 12*e*.

An upper cylindrical side section 12*b* is also depicted.

In embodiments, a side view of the buoyant structure 10 is shown with a cylindrical neck 8 and two sets of parallel frames 92*a*-92*d* and 92*e*-92*h*. Each set of parallel frames extends from the keel 12*f*.

Each set of parallel frames is mounted in parallel with each other and connected to the keel.

Figure 15A:
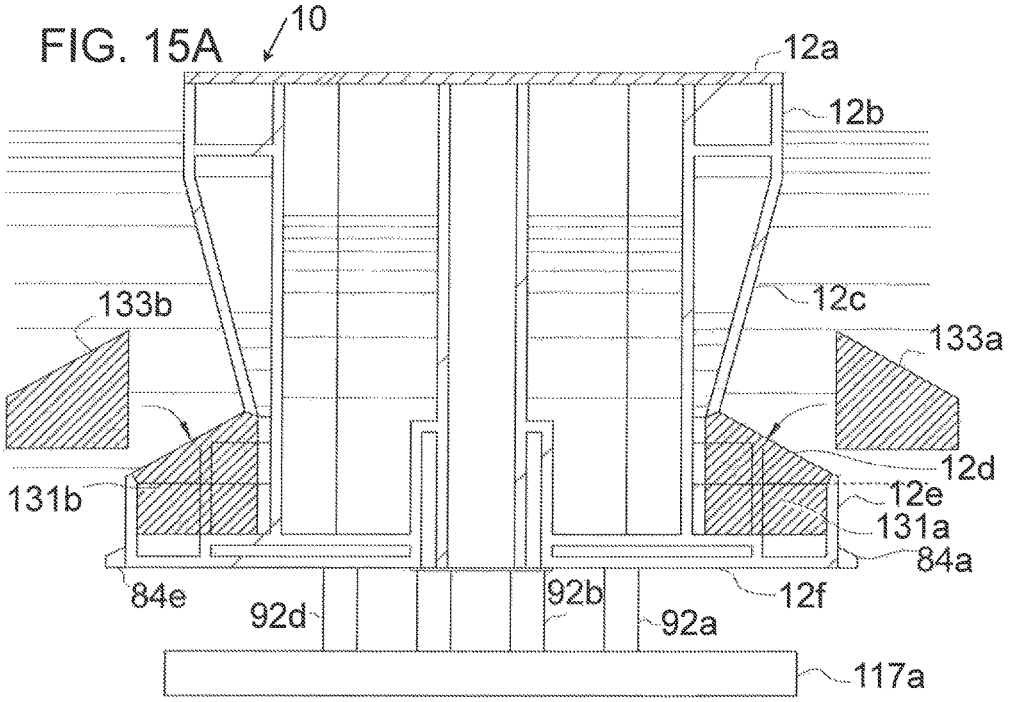
FIG. 15A depicts a section view of the buoyant structure according to one or more embodiments.
Figure 15B:
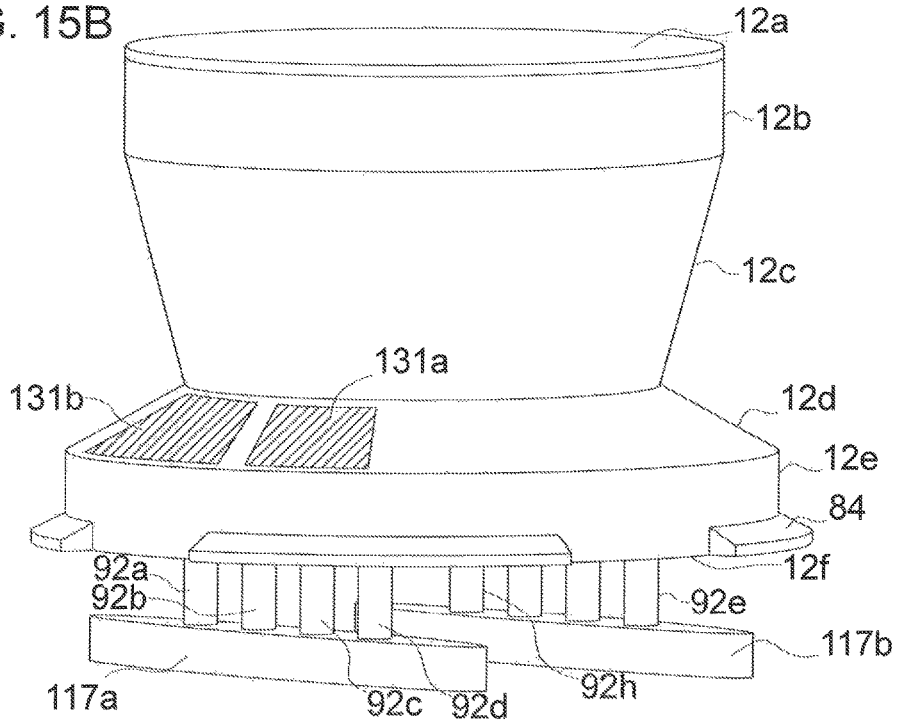
FIG. 15B depicts an isometric view of the buoyant structure according to one or more embodiments.

FIGS. 15A and 15B depict a section view of a buoyant structure 10 according to one or more embodiments.

The buoyant structure 10 with a hull can have a main deck 12*a*.

In embodiments, the hull can be ballasted to move between a transport depth and an operational depth 71.

Fin shaped appendages 84*a*-84*e* are configured to dampen movement of the buoyant structure 10 as the buoyant structure 10 moves from side to side in water.

A lower inwardly tapering frustoconical side section 12*c* can extend from the main deck 12*a*.

An upper cylindrical side section 12*b* is shown between the main deck 12*a* and the lower inwardly tapering frustoconical side section 12*c*.

A lower generally rounded section 12*e* can extend from the lower inwardly tapering frustoconical side section 12*c*.

In embodiments, each lower generally rounded section 12*e* can have a plurality of openings 131*a*-131*b* for receiving inserts 133*a*-133*b* for ballasting.

In embodiments, the buoyant structure 10 can have a generally rounded keel 12*f*.

A fin-shaped appendage 84 can be secured to a lower and an outer portion of the exterior of the generally rounded keel 12*f*.

A plurality of parallel frame 92*a*-92*d* can extend from the generally rounded keel 12*f* and support a keel extension 117*a* which can be a cofferdam.

The keel extension 117 can be connected to the parallel frames 92*a*-92*d*.

The keel extension 117*a* can be a pair of cofferdams mounted in parallel separated by the parallel frames or a pair of cofferdams mounted with the parallel frames mounted apart and in parallel to each other. The keel extension can be a cofferdam containing a portion of a group of the parallel frames.

Figure 16:
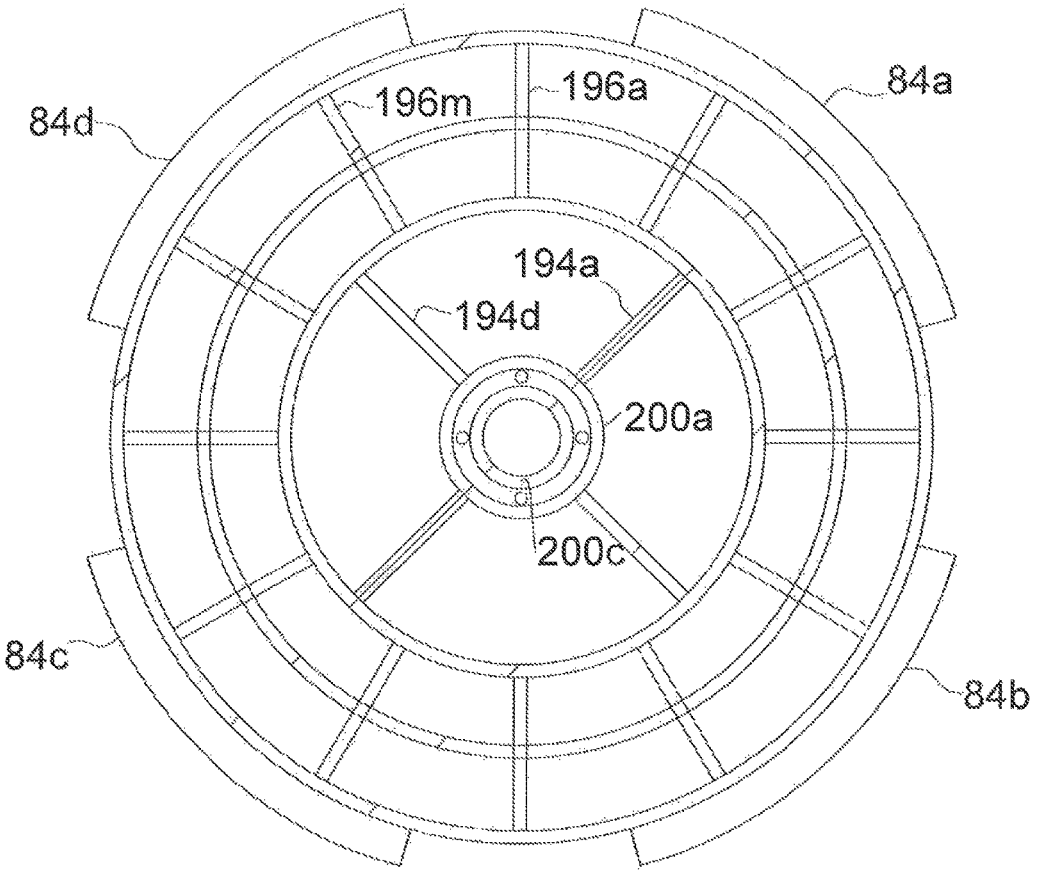
FIG. 16 depicts a cross section of the buoyant structure according to one or more embodiments with a fin configuration for damping.

FIG. 16 depicts a cross section of the buoyant structure 10 according to one or more embodiments with a fin configuration for dampening.

The fin-shaped appendages 84*a*-84*d* are shown in this bottom view of the buoyant structure 10.

The plurality of parallel frames can be concentric in this embodiment and include support structures 196*a*-196*m* as well as cross members 194*a*-19*d* with additional concentric supports 200*a*-200*c*.

FIGS. 17A-17E depict various embodiments of the keel extension. The different embodiments are shown as keel extensions 117*a*-117*g*.

Some of the keel extensions are depicted with an angular face in accordance with one or more embodiments.

The keel extensions in embodiments are connected to one or more of the plurality of parallel frames.

Figure 17A:
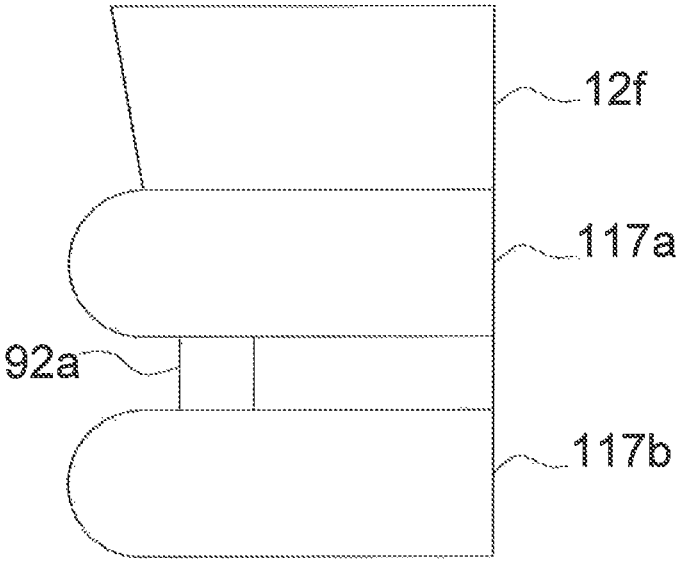
FIGS. 17A-17E depicts different embodiments of the keel extensions.

In embodiments, FIG. 17A shows a first keel extension mounted directly to the keel 12*f* and mounted in parallel with the generally rounded keel 12*f*. At least one parallel frame 92*a* extends from the first keel extension 117*a* and engages a second keel extension 117*b* mounted in parallel to the first keel extension.

Figure 17B:
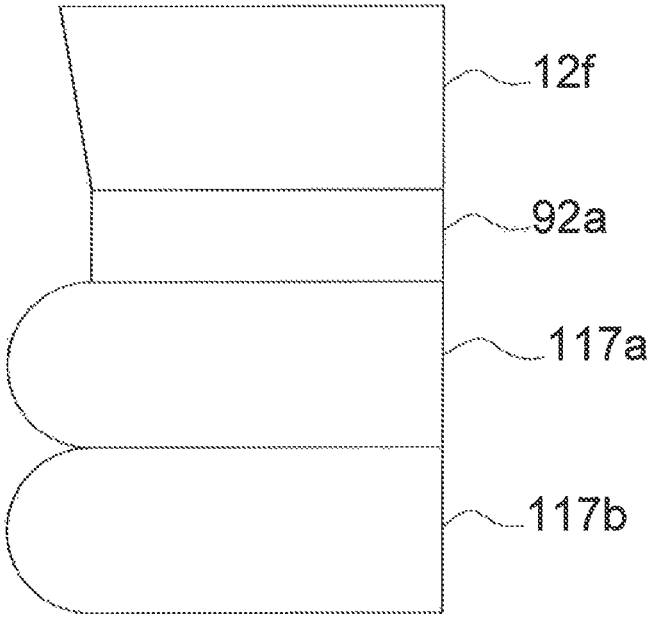

In embodiments, FIG. 17B shows a first keel extension 117*a* mounted directly to the keel 12*f* and mounted in parallel with the generally rounded keel 12*f*. A second keel extension 117*b* mounted in parallel to the first keel extension directly engages the first keel extension. Both keel extensions have rounded ends, like a cofferdam.

Figure 17C:
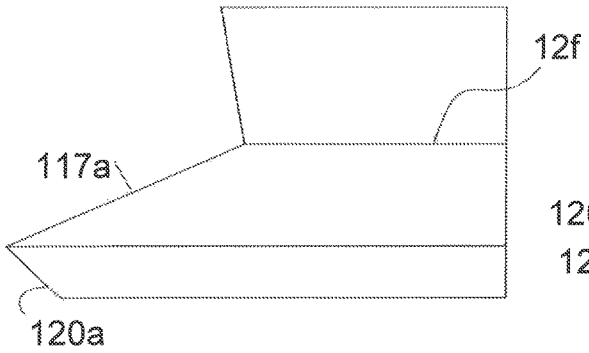

In embodiments, FIG. 17C shows a first keel extension 117*a* mounted directly to the keel 12*f* and mounted in parallel with the generally rounded keel 12*f* having an angular face 120*a*.

Figure 17D:
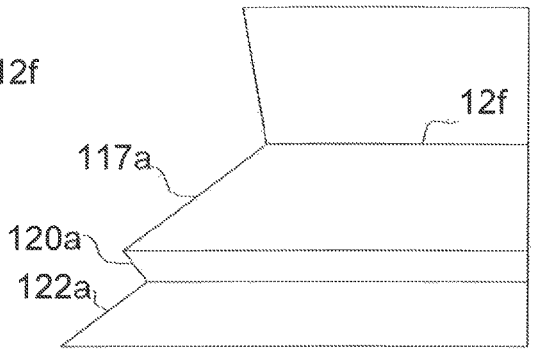

In embodiments, FIG. 17D shows a first keel extension 117*a* mounted directly to the keel 12*f* and mounted in parallel with the generally rounded keel 12*f* having an angular face 120*a*, and a second angular face 122*a*.

Figure 17E:
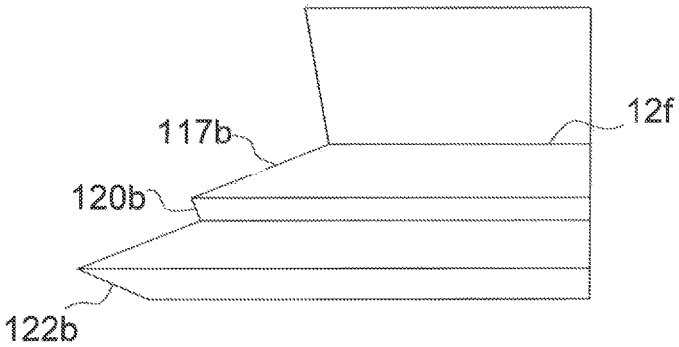

In embodiments, FIG. 17E shows a first keel extension 117*b* mounted directly to the keel 12*f* and mounted in parallel with the generally rounded keel 12*f* having an angular face 120*b*, and a second angular face 122*b* in a stepped and separated configuration.

Figure 18A:
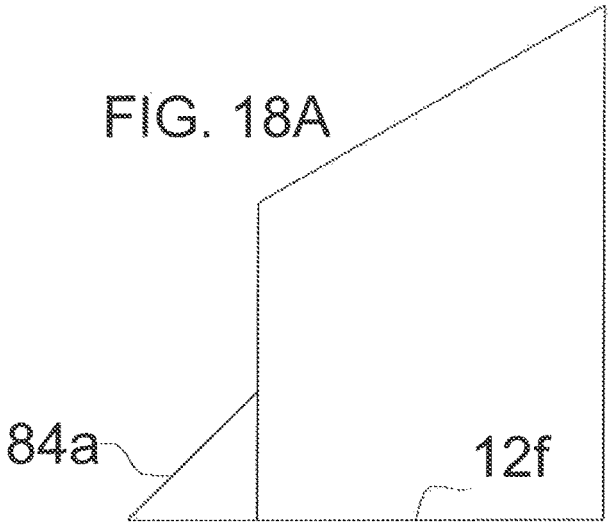
FIGS. 18A-18C depict different embodiments of the fins as a pair of humps and one or two triangular projections.
Figure 18B:
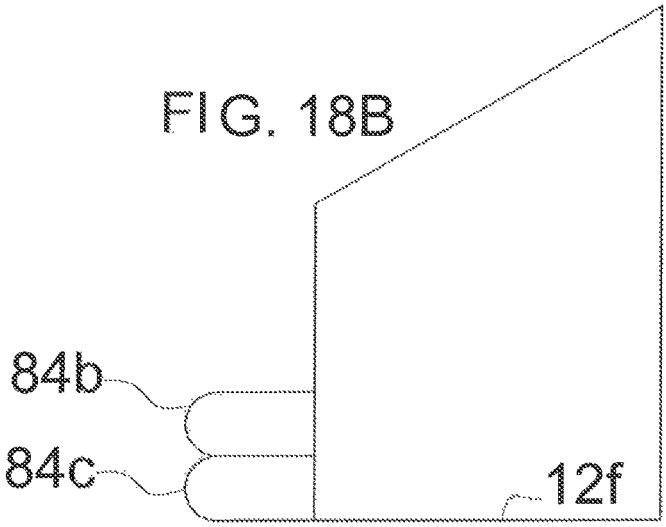
Figure 18C:
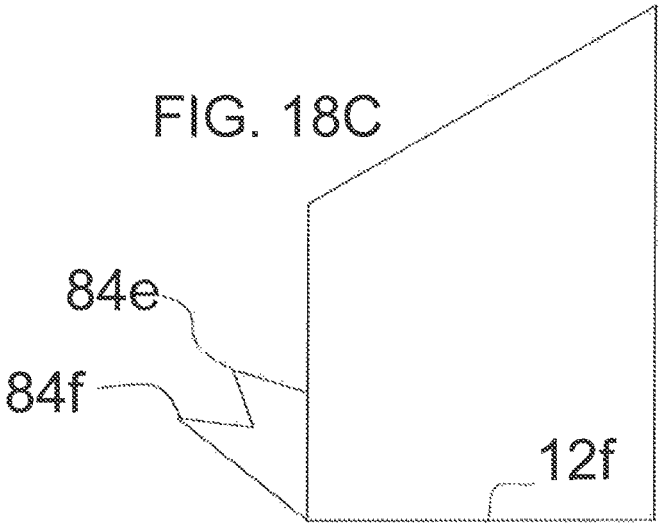
Figure 19A:
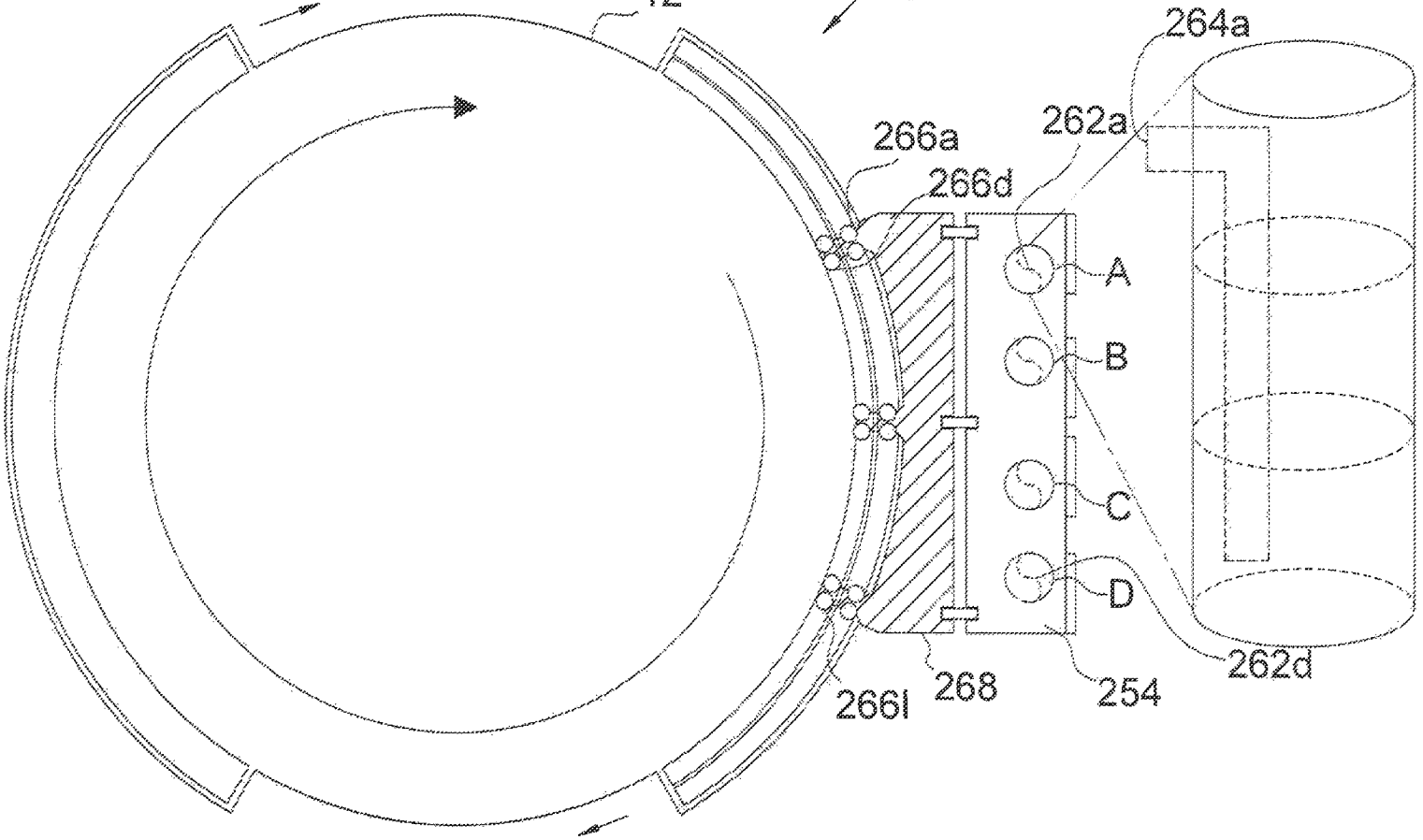
FIG. 19A-19D depict the offloading device according to one or more embodiments.
Figure 19B:
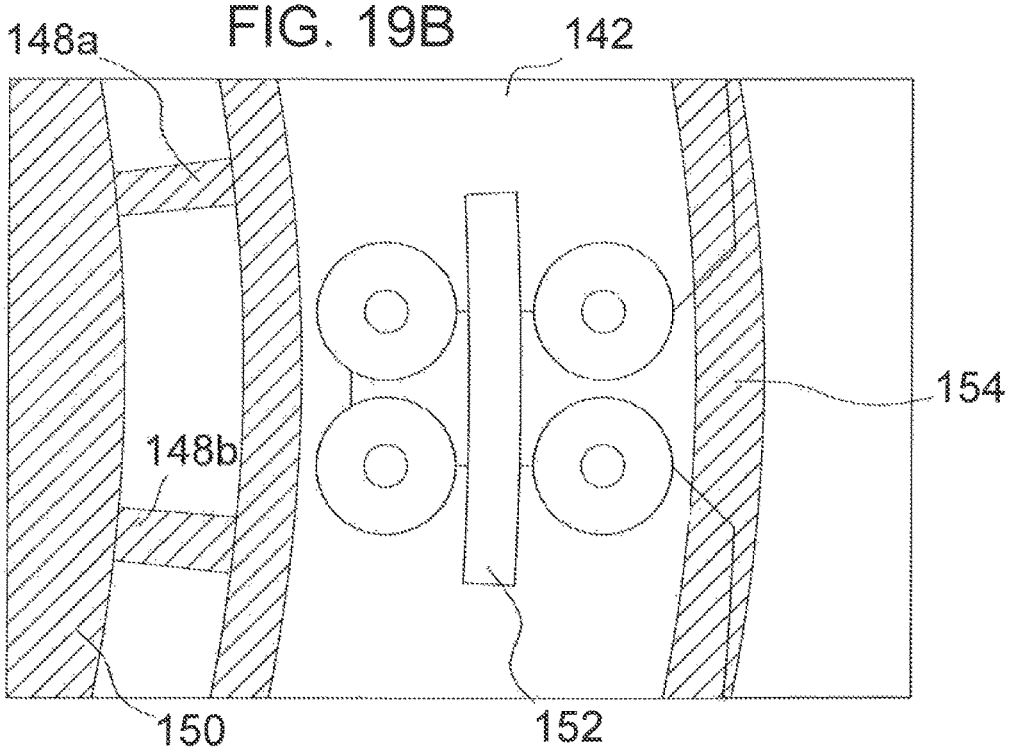
Figure 19C:
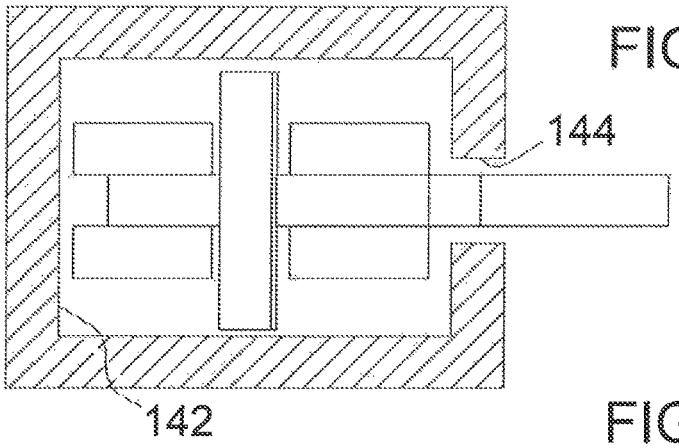
Figure 19D:
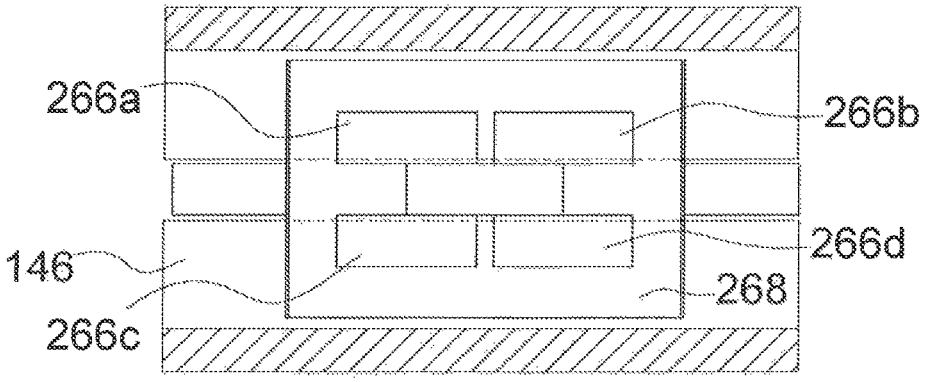

FIGS. 18A-18C depict the fin shaped appendage 84 according to one or more embodiments.

A triangular fin-shaped appendage 84*a* can be secured to a lower and an outer portion of the exterior of the generally rounded keel 12*f* as shown in FIG. 18A.

The fin shaped appendage can be a pair of humps 84*b* and 84*c* as shown in FIG. 18B.

The fin shaped appendage can be a pair of triangular projections 84*e* and 84*f* as shown in FIG. 18C.

FIGS. 19A-19D depict the offloading device according to one or more embodiments.

The offloading device 181 is slidably connected to an outside surface of the hull 12.

The offloading device 181 has a nearly fully enclosed tubular channel 142 with a rectangular cross-section and a longitudinal slot 144 on a side wall 146 of the tubular channel, a set of standoffs 148*a*-148*b* that connect the tubular channel 142 horizontally to an outside wall 150 of the hull 12, and a trolley 152 captured and moveable within the tubular channel 142, a trolley connector 154 attached to the trolley 152 providing a connection point to a platform 254 containing ballast chambers 262*a*-262*d*.

A plurality of ballast inlets and outlets 264*a* are formed in the nearly fully enclosed tubular channel.

In embodiments, the trolley 152 has a plurality of wheels 266*a*-266*l* mounted on ends of a base plate 268.

While these embodiments have been described with emphasis on the embodiments, it should be understood that within the scope of the appended claims, the embodiments might be practiced other than as specifically described herein.

What is claimed is:

1. A buoyant structure comprising:

a. a hull having a main deck, the hull further comprising:
   (i) a lower inwardly-tapering frustoconical side section that extends from the main deck;
   (ii) a lower generally rounded section extending from the lower inwardly-tapering frustoconical side section;
   (iii) a generally rounded keel;

b. a fin-shaped appendage secured to a lower and an outer portion of the exterior of the hull proximate the generally rounded keel, the fin shaped appendage having a shape selected from the group consisting of: a triangular shape, a hump shape and a pair of connected triangular projections shape; and c. a moveable center pendulum configured to move between a transport depth and an operational depth.

2. The buoyant structure of claim 1, comprising an upper cylindrical side section extending from the main deck engaging the lower inwardly-tapering frustoconical side section.

3. The buoyant structure of claim 1, comprising a cylindrical neck connected between the lower inwardly-tapering frustoconical side section and the lower generally rounded section.

4. The buoyant structure of claim 1, wherein the hull is ballasted to move between a transport depth and an operational depth, and wherein the fin shaped appendage is configured to dampen movement of the buoyant structure as the buoyant structure moves in water.

5. The buoyant structure of claim 1, wherein the main deck has a superstructure comprising at least one member selected from the group consisting of: crew accommodations, a heliport, a crane, a control tower, a dynamic position system in the control tower, and an aircraft hangar.

6. The buoyant structure of claim 1, comprising a plurality of fin-shaped appendages separated from each other and disposed equidistantly around the hull.

7. The buoyant structure of claim 3 comprising: a lower frustoconical side section extending from the cylindrical neck.

8. The buoyant structure of claim 1 comprising a lower frustoconical side section extending downwardly from the lower inwardly-tapering frustoconical side section.

9. The buoyant structure of claim 1, comprising: a plurality of openings in the lower generally rounded section for receiving inserts for ballasting.

* * * * *